US005380615A

United States Patent [19]

Tokuno

[11] Patent Number: 5,380,615

[45] Date of Patent: Jan. 10, 1995

[54] PROCESS FOR PRODUCING A TONER FOR DEVELOPMENT OF ELECTROSTATIC CHARGED IMAGE

[75] Inventor: Toshiro Tokuno, Takarazuka, Japan

[73] Assignee: Mita Industrial Co., Ltd., Osaka, Japan

[21] Appl. No.: 336,339

[22] Filed: Apr. 11, 1989

[30] Foreign Application Priority Data

Apr. 12, 1988 [JP] Japan ..... 63-89733

[51] Int. Cl.[6] ..... G03G 9/00

[52] U.S. Cl. ..... 430/109; 430/137; 524/847

[58] Field of Search ..... 430/109, 137; 524/847

[56] References Cited

U.S. PATENT DOCUMENTS 4,656,113 4/1987 Ohshima et al. ..... 430/137
4,681,832 7/1987 Tachikawa et al. ..... 430/115
4,731,292 3/1988 Sasaki et al. ..... 428/425.9
4,816,366 2/1989 Hyosu et al. ..... 430/137
4,880,857 11/1989 Mori et al. ..... 430/109
4,983,488 1/1991 Tan et al. ..... 430/137

FOREIGN PATENT DOCUMENTS 0106250 8/1981 Japan ..... 430/109
8118834 7/1983 Japan ..... C08J 9/18
0063544 4/1985 Japan ..... 430/137

*Primary Examiner*—Marion E. McCamish
*Attorney, Agent, or Firm*—Sherman and Shalloway

[57] ABSTRACT

A toner composition is produced by bulk- or solution-polymerizing a fixer resin in the presence of toner-characteristic imparting agents such as a colorant and a charge controlling agent. According to this process, unlike a suspension polymerization method, since no surface-active agent is used at any stage of production, the produced toner is remarkably proof against moisture. Especially, if a grafted carbon black is used as the colorant, it is possible to obtain a toner in which the colorant is dispersed minutely and uniformly throughout the fixer resin.

17 Claims, 1 Drawing Sheet

PROCESS FOR PRODUCING A TONER FOR DEVELOPMENT OF ELECTROSTATIC CHARGED IMAGE

BACKGROUND OF THE INVENTION 1. Field of the Invention:

The present invention relates to a process for producing a toner for use in developing an electrostatic latent image in electrophotography, electrostatic printing, electrostatic recording/printing, etc. 2. Description of the Prior Art:

In known copying machines utilizing the principle of electrophotography, a toner in which additives such as a colorant are dispersed in a fixer resin, was used for the purpose of making visible an electrostatic latent image that is formed on a photosensitive plate or drum of selenium or other organic photoconductive material.

According to this known developing method, an electrostatic latent image formed on the photosensitive drum by charging the drum surface and then by exposing the charged drum surface to light is developed by the toner, and then the developed toner image is transferred to a substrate such as a copy paper, whereupon the toner image is fixed to the substrate by a heater roller or a pressure roller. Thus a visible image has been formed on the substrate. After the toner image has been transferred to the substrate, the leavings of the toner particles on the drum surface are cleared off by a cleaning means such as a scraper blade.

The toner is composed of resin particles of 1 to 30 $\mu$m particle size in which toner-characteristic imparting agents such as a colorant and a charge controlling agent are dispersed in a fixer resin. The resulting toner is then mixed with a carrier to form a developer.

The carrier is in the form of iron powder or ferromagnetic powder. In development, the resultant developer forms a magnetic brush by the action of a magnet roll of a developing unit. As the magnet roll is rotated, the magnetic brush is brought toward the electrostatic latent image area, where only the toner is adhered to the latent image to develop a visible image. In order to reproduce the original image with fidelity, the individual toner particles are required to have a uniform electric charge so that the image density is kept from lowering due to the decrease of amount of the toner adhered to the latent image, which is caused partly due to the transfer of the uncharged toner particles to the area outside the latent image and partly due to the accumulation of the overcharged toner particles in the developing unit.

At the stage of fixing, the toner is also required to have a delicate heat-melt characteristic and a specific viscosity so that the toner is allowed to be fixed quickly without causing an offset phenomenon, in which as it passes an image-fixing roller, the next substrate is stained with part of the toner adhered to the surface of a fixing roller during the fixing of the toner image on the preceding substrate.

As discussed above, at different stages of the copying process, various characteristics and properties are required within the toner in the form of coloring resin particles in order to assist individually and in combination in forming a clear image.

Further, in recent years, toners are used in copying machines, printers, facsimile machines, and color copying or printing machines. In order to meet these expanding applications and the demand of the color age, a manufacturer must produce various kinds of toners each in a relatively small quantity.

Conventionally, a toner was produced by providing a kneaded product by applying a great shearing force to a mixture of a fixer resin, a colorant, a charge controlling agent, etc. to soften the fixer resin and also to disperse the colorant in the Fixer resin, and then by pulverizing and sizing the kneaded product as cooled.

In this conventional method of production, partly because molecule chains in the fixer resin tend to be broken off due to the great shearing force, and partly because the distribution of molecular weight tends to shift to the low, there is a danger that the resin characteristics would be modified remotely From the requirements. Further, non-uniform dispersion of the colorant and other additives tends to occur due to the varying local molecular weight of the resin, and yet adequate Fixing and developing characteristics, especially For a high-resolution image, can hardly be achieved by adjusting the degree of kneading. Moreover, this melt-kneading requires a great amount of energy and hence a large-scale apparatus, which are cost-consuming. Therefore this conventional method is not suitable for use in manufacturing many kinds of toners each in a small quantity at a high rate of production.

Meanwhile, many proposals were made with the hope to improve the suspension-polymerization method, by which resin particles of the required toner size can be obtained at the stage of polymerization of the fixer resin. In this known method, however, partly because it is a must to use a dispersion stabilizer for stabilizing suspension oil-drop particles in water phase, and partly because the dispersion is adhered to the produced toner particles, the resultant toner is highly dependent on moisture so that deterioration of an image would occur at high humidity.

SUMMARY Of THE INVENTION

With the foregoing prior art problems in view, it is an object of the present invention to provide a process for producing a toner in which toner-characteristics of imparting agents such as a colorant are dispersed uniformly in a fixer resin without modifying the molecule properties of the fixer resin. The resultant toner is offset-free and moisture resistant and has good developing and fixing performance. By the process of the present invention, it is possible to produce such a toner in simple steps using a simple apparatus or equipment with a reduced amount of consumed energy, which is very cost-saving.

According to the present invention, there is provided a process for producing a toner for use in developing an electrostatic charged image, comprising the steps of: providing a Polymerizable composition composed of a fixer-resin-forming monomer in which toner-characteristic imparting agents such as a colorant and a charge controlling agent are dissolved or dispersed; forming a polymerized product from the polymeric composition by polymerizing the polymeric composition directly or by polymerizing the polymeric composition as dissolved in an organic solvent in the presence of a polymerization initiator; and pulverizing the polymerized product as cooled, or spray-granulating the polymerized product as dissolved in a solution.

Specifically, at the polymerizing step, the polymeric monomer is bulk-polymerized or solution-polymerized in the presence of the toner-characteristic imparting agents dissolved or dispersed in the fixer resin. The resultant product has desired resin characteristics, with the toner-characteristic imparting agent being dispersed uniformly in the fixer resin. Finally this polymerized product is granulated into a required toner size. dr

DETAILED DESCRIPTION Of THE PREFERRED EMBODIMENTS

Fixer-resin-forming monomer

Figure 1:
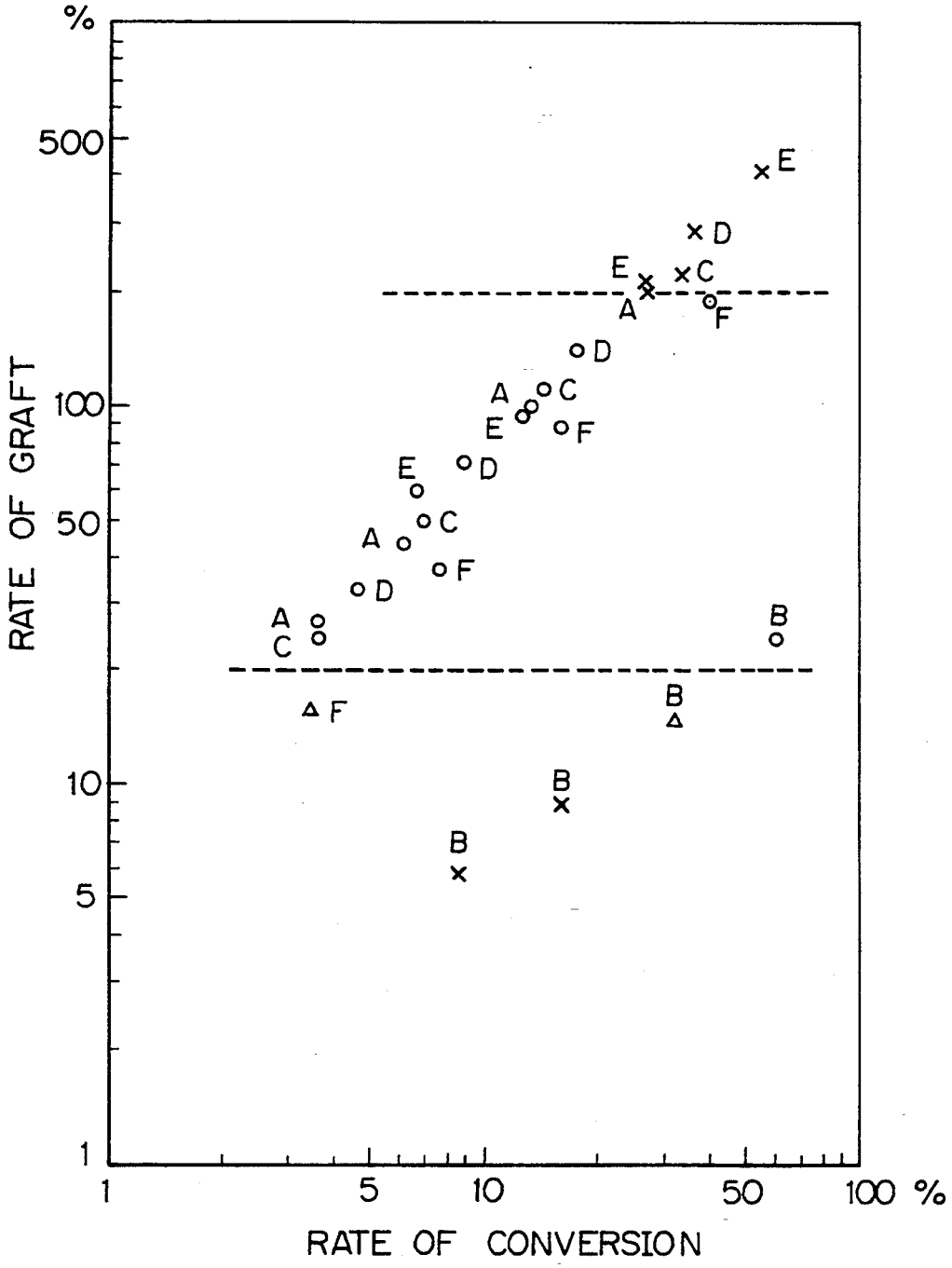
FIG. 1 is a diagram showing the relation between the rate of graft of a grafted carbon black and the rate of conversion of a fixer-resin-forming monomer to a polymer, and also showing relation between the rate of graft of the grafted carbon black and the dispersion characteristic of the grafted carbon black in the fixer-resin-forming monomer.

The fixer-resin-forming monomer used in the present invention gives a polymer having both fixability and chargeability required of a toner. Examples of suitable monomers are vinyl aromatic monomers, acrylic monomers, vinyl ester monomer, vinyl ether monomers, diolefin monomers and monoolefin monomers.

The vinyl aromatic monomers are, for example, vinyl aromatic hydrocarbons of the formula

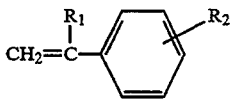

(1)

wherein R1 represents a hydrogen atom, a lower alkyl group, or a halogen atom, and $R_2$ represents a hydrogen atom, a lower alkyl group, a halogen atom, an alkoxy group, a nitro group, or a vinyl group.

Specific examples include styrene, α-methylstyrene, vinyltoluene, α-chlorostyrene, o-, m- or p-chlorostyrene, p-ethylstyrene, and divinylbenzene. They may be used individually or in combination.

Examples of the other monomers mentioned above are:

Acrylic monomers of the formula

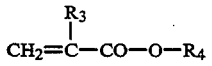

(2)

wherein $R_3$ represents a hydrogen atom or a lower alkyl group, and $R_4$ represents a hydrogen atom, a hydrocarbon group having up to 12 carbon atoms, a hydroxyalkyl group, or a vinyl ester group.

Specific examples include methyl acrylate, ethyl acrylate, 2-ethylhexyl acrylate, cyclohexyl acrylate, phenyl acrylate, methyl methacrylate, hexyl methacrylate, 2-ethylhexyl methacrylate, ethyl β-hydroxyacrylate, propyl γ-hydroxyacrylate, butyl δ-hydroxyacrylate, ethyl β-hydroxymethacrylate, propyl α-aminoacrylate, esters of ethylene glycol dimethacrylic acid and esters of tetraethylene glycol dimethacrylic acid.

Vinyl esters of the formula

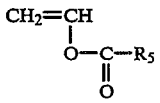

(3)

wherein $R_5$ represents a hydrogen atom or a lower alkyl group.

Specific examples include vinyl formate, vinyl acetate and vinyl propionate.

Vinyl ethers of the formula

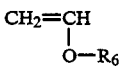

(4)

wherein $R_6$ represents a monovalent hydrocarbon group having up to 12 carbon atoms.

Specific examples include vinyl n-butyl ether, vinylphenyl ether and vinyl cyclohexyl ether.

Diolefins of the formula

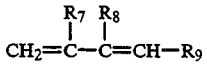

(5)

wherein each of R7, $R_8$ and $R_9$ represents a hydrogen atom, a lower alkyl group or a halogen atom.

Specific examples are butadiene, isoprene and chloroprene.

Monoolefins of the formula

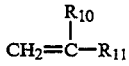

(6)

wherein each of $R_{10}$ and $R_{11}$ represents a hydrogen atom or a lower alkyl group.

Specific examples are ethylene, propylene, isobutylene, butene-1, pentene-1 and 4-methylpentene-1.

Of the above-mentioned monomers, suitable monomers in view of the control of molecular weight distribution are styrene-type monomers, acryl-type monomers, etc.

Toner-characteristic imparting agents In the present invention, toner-characteristic imparting agents such as a colorant and a charge controlling agent are dissolved or dispersed in the above-mentioned monomer.

The colorant is exemplified by the following pigments or dyes (hereinafter called "pigments").

Black pigments

Carbon black, acetylene black, lamp black, and aniline black.

Yellow pigments

Chrome yellow, zinc yellow, cadmium yellow, yellow iron oxide, mineral fast yellow, nickel titanium yellow, Naple's Yellow, Naphthol Yellow S, Hansa Yellow 10G, Benzidine Yellow CR, Quinoline Yellow Lake, Permanent Yellow NCG, and Tartrazine Lake.

Orange pigments

Chrome orange, molybdenum orange, Permanent Orange GTR, Pyrazolo Orange, Vulcan Orange, Indanthrene Brilliant Orange RK, Benzidine Orange G and Indanthrene Brilliant Orange GK.

Red pigments

Red iron oxide, cadmium red, red lead, cadmium mercury sulfide, Permanent Red 4R, Lithol Red, Pyrazolo Red, Watching Red calcium salt, Lake Red D, Brilliant Carmine 6B, Eosine Lake, Rhohdamine Lake B, Alizarin Lake and Brilliant Carmine 3B.

Violet pigments

Manganese violet, fast Violet B, and Methyl Violet Lake.

Blue pigments

Prussian blue, cobalt blue, Alkali Blue Lake, Victoria Blue Lake, Phthalocyanine Blue, Metal-free Phthalocyanine Blue, a partially chlorinated product of Phthalocyanine Blue, fast Sky Blue and Indanthrene Blue BC.

Green pigments

Chrome green, chromium oxide, Pigment Green B, Malachite Green Lake, and Fanal Yellow Green G.

White pigments

Zinc flower, titanium dioxide, antimony white and zinc sulfide.

Body extender pigments

Baryte powder, barium carbonate, clay, silica, white carbon, talc and alumina white.

Known magnetic material pigments include, for example, $Fe_3O_4$, $\gamma$-$Fe_2O_3$, $ZnFe_2O_4$, $Y_3Fe_5O_{12}$, $Cd_3Fe_5O_{12}$, $CuFe_2O_4$, $PbFe_{12}O_{19}$, $NdFeO_3$, $BaFe_{12}O_{19}$, $MgFe_2O_4$, $MnFe_2O_4$, $LaFeO_3$, Fe powder, Co powder and Ni powder. Also in the present invention, a fine powder of any of these known magnetic materials may be used. In addition, oil-soluble dyes such as C.I. Solvent Yellow 60, C.I. Solvent Red 27, or C.I. Solvent Blue 35 may be used.

It is preferable that among the above-mentioned colorants, the one poorly compatible with the fixer-resin-forming monomer be surface-modified to improve its compatibility.

Surface modification may be done by known surface-treating methods using various coupling agents. Instead, in the present invention, it is effective to do a graft treatment so as to incorporate polymer chains in the colorant molecules.

tioned fixer-resin-forming monomer in the presence of a colorant. In that case, it is important to control the reaction in such a manner that the rate of graft (ratio of the weight of polymer chains bonded to a colorant to of the weight of the colorant before grafted) is within a range of from 20 to 200%.

Table 1 shows various properties of each of six kinds of carbon blacks. Table 2 shows the relation between the rate of graft, the rate of conversion to a polymer and the dispersibility and the reaction time when graft-polymerized in a styrene monomer of each of these six carbon blacks. Further, the relation between the rate of graft and the rate of conversion to a polymer and also the relation between the rate of graft and the dispersibility are shown in FIG. 1. In Tables 1 and 2 and FIG. 1, "rate of conversion" means the rate of graft to a polystyrene when a grafted carbon black as dispersed in a styrene monomer is polymerized, and "dispersibility" means the dispersibility when a grafted carbon black is dispersed in a styrene monomer.

TABLE 1

| Carbon Black | BET surface area ($m^2/g$) | DBT oil absorption (ml/100 g) | PH Value |
|---|---|---|---|
| A | 240 | 130 | 2.7 |
| B | 153 | 124 | 7.5 |
| C | 300 | 95 | 10 |
| D | 260 | 65 | 7.0 |
| E | 200 | 80 | 7.0 |
| F | 254 | 185 | 8.5 |

TABLE 2

| | Reaction time | | | | | | | | | | | |
|---|---|---|---|---|---|---|---|---|---|---|---|---|
| | 0.5 hour | | | 1 hour | | | 2 hours | | | 4 hours | | |
| Carbon Black | Rate of graft (%) | Rate of conversion (%) | Dispersibility | Rate of graft (%) | Rate of conversion (%) | Dispersibility | Rate of graft (%) | Rate of conversion (%) | Dispersibility | Rate of graft (%) | Rate of conversion (%) | Dispersibility |
| A | 26 | 3.5 | ○ | 45 | 6.4 | ○ | 98 | 13 | ○ | 208 | 27 | Δ |
| B | 5.9 | 8.9 | X | 9.3 | 17 | X | 15 | 33 | Δ | 24 | 62 | ○ |
| C | 24 | 3.6 | ○ | 51 | 7.1 | ○ | 116 | 15 | ○ | 217 | 35 | X |
| D | 33 | 4.7 | ○ | 70 | 9.2 | ○ | 147 | 19 | ○ | 291 | 38 | X |
| E | 51 | 6.7 | ○ | 97 | 13 | ○ | 219 | 28 | X | 415 | 59 | X |
| F | 16 | 3.4 | Δ | 36 | 7.4 | ○ | 84 | 16 | ○ | 185 | 42 | ○ |

○ ... found particles of less than 1 μm diameter
Δ ... found here and there coagulated lumps of over 1 μm diameter
X ... found many coagulated lumps of over 1 μm diameter This grafting enables any of various colorants, which are different in chemical or physical properties such as a pH value and a specific surface area, to be dispersed minutely and uniformly in a monomer for forming a fixer resin.

This grafting is remarkably effective when adopted to a carbon black having a polar group in its surface. That is, carbon black, as its nature, has a particularly poor compatibility with a fixer-resin-forming monomer, which is oleophilic; but this compatibility of carbon black can be remarkably improved by the grafting.

Another advantageous result of the grafting is that since quinoid oxygen disposed in the colorant surface covered, the polymerization inhibiting action of the quinoid oxygen would be retarded during the polymerization and, as a result, both the rate or polymerization of the fixer-resin-forming monomer and rate of conversion of the monomer to a polymer (a fixer resin) can be maintained at high level.

The above-mentioned graft treatment is to incorporate polymer chains in colorant molecules and can be accomplished by pre-polymerizing the above-men- As is apparent also from Table 2 and FIG. 1, the dispersibility of the individual carbon black is not dependent on the rate or conversion, and the individual carbon black grafted at a rate of from 20 to 200% gave a good dispersibility in a polymerizable monomer. In the case where the rate of graft was outside the above-mentioned range, a grafted carbon black has an inferior dispersibility and many coagulated lumps of over 1 μm in diameter were found polymerizable in the polymeric monomer.

The rate of graft was calculated in the following manner:

(1) Using an ultra-centrifuge, a pre-polymer containing a grafted carbon black was centrifuged at a speed of 20,000 to 30,000 rpm to precipitate the grafted carbon black, leaving a supernatant above the settled-out carbon black. This supernatant, which was composed of an unpolymerized polymerizable monomer and a homopolymer not bonded with the carbon black, was removed.

(2) After the grafted carbon black obtained by step (1) was completely dispersed adding THT (tetrahydrofuran), the above-mentioned centrifugation and a subsequent decantation were repeated several times to remove any residual homopolymer.

(3) The grafted carbon black obtained by step (2) was dried under reduced pressure, whereupon the weight of the resulting grafted carbon black was measured with precision.

(4) The difference between the mass of this resultant grafted carbon black and the mass or the carbon black before reaction, and the mass of the bonded polymer was obtained to calculate the rate of graft.

The amount of the colorant to be used in the present invention varies in a very wide range, depending on the kind of the colorant. Practically, however, colorant and the monomer may be used at a weight ratio of 1:ϕto 20:100, especially 3:100 to 10:100.

further, in the present invention, a charge controlling agent is incorporated in the polymerizable monomer in order to improve the charging characteristic of the toner. Examples of this charge controlling agent are Nigrosine, monoazo dye, zinc hexadecylsuccinate, alkylester or alkylamide of naphthoic acid, nitrohumic acid, N,N'-tetramethyldiaminbenzophenone, N,N'-tetramethylbenzidine, triazine, or metal-salicylate complex, which are all known in the art as having a strong polarity. 0.0to 10 parts by weight of this charge controlling agent per 100 parts by weight of the polymerizable monomer are used.

It is preferred to pre-pulverize the charge controlling agent under dry conditions before being incorporated in the polymerizable monomer. Because of this prepulverizing, it is possible to disperse the charge controlling agent in the monomer minutely and much more effectively.

As the dye is pre-pulverized under dry conditions a fresh surface, which is greatly active, would come out so that the dye particles can be dispersed in the monomer because they have the same polarity and are repelled from one another due to the charge of a polar group disposed in this new surface of the individual dye particle.

Also, to impart an offset preventing effect and to improve the fixing properties, a wax may be admixed in the above-mentioned monomer. Examples of the wax are low-molecular-weight polypropylene, low-molecular-weight polyethylene, paraffin wax or other wax. The preferred average molecular weight of the wax is in a range of from 2,000 to 15,000, especially 3,000 to 10,000.

Generally, it is preferred to use 1 to 5 parts by weight, especially 1.5 to 3 parts by weight, of the wax per 100 parts by weight of the fixer-resin-forming monomer.

Preparation of polymerizable composition

In the present invention, a polymerizable composition is prepared by dissolving or dispersing the toner-characteristic imparting agents, such as the above-mentioned colorant, charge controlling agent and wax in the fixer-resin-forming monomer at the above-mentioned ratio.

At that time, if a grafted colorant is used, it is preferred that the fixer-resin-forming monomer is prepolymerized in the presence of the colorant to be grafted, then the colorant is treated by grafting such that the rate of graft is within the above-mentioned range, and then the resulting product,-along with the other additive components, is dissolved or dispersed in the remaining fixer-resin-forming monomer.

for addition of a wax, after the wax is charged in the monomer, this mixture is heated at a temperature below the polymerizing temperature until the wax is completely dissolved in the monomer. Then it is preferred to cool the resultant composition to ordinary temperature. As a result, the wax has been minutely dispersed in the polymerizable composition.

Moreover, to assist in stabilizing the dispersion of the charge controlling agent and the wax in the monomer, a polymer having a polar group may be incorporated. This polymer may comprise one of the following homopolymers which are polar monomers, or may comprise a copolymer composed of the above-mentioned polymerizable monomer and one of the polar monomers.

Anionic monomer

The anionic monomer used in the present invention is exemplified by unsaturated carboxylic acid such as acrylic acid and methacrylic acid, unsaturated dibasic acid such as maleic acid and fumaric acid, anhydride of unsaturated dibasic acid such as maleic anhydride and iraconic anhydride, styrene sulfonic acid, 2-acrylamid-2-2 methylpropanesulfonic acid, mono-(2-methacryloyloxyethyl)acid phosphate, and 2-methacryloyloxyethylsuccinic acid.

Cationic monomer

The cationic monomer may be a nitrogen-containing monomer such as dimethylamino(meth)acrylate, diethylamino-ethyl(meth)acrylate, diethylaminopropyl(meth)acrylate, N-aminopropyl(meth)acrylate, vinyl pyridine, and 2-vinyl imidazole, and 2-hydroxy-3-acryloxypropylethyl ammonium chloride.

A suitable polar-group-containing polymer such as the above-mentioned polar monomer is selected partly from a view point of the solubility in the polymeric monomer, capable of forming the above-mentioned fixer resin, and partly from a view point of the charging characteristics of a toner to be produced. In general, 0.to 10 parts by weight of the polar-group-containing polymer per 100 parts by weight of the polymerizable monomer is used.

Polymerization process

The polymerizable composition in which the above-mentioned colorant, charge controlling agent, offset preventing agent, etc. are dispersed and mixed, is polymerized so as to have a desired molecule characteristic. This polymerization may be bulk polymerization, solution polymerization or other polymerization; but it is preferred to use solution polymerization from a view point of the radiation and removal of reaction heat and the control of molecular weight. An organic solvent for use in solution polymerization may be any desired one, as long as it is not influential on polymerization.

Especially in solution polymerization, polymerization is carried out in the presence of a polymerization initiator. Examples of the polymerization initiator are an azo compound such as azobisisobutyronitril, cumene hydroperoxide, di-t-butylhydroperoxide, dicumylperoxide, benzoyl peroxide, and lauryl peroxide, which are all soluble in oil. Alternatively, the initiator may be used in combination with a suitable sensitizer, or ionizing radiation such as gamma-accelerated electron beams.

The polymerization initiator, such as azo compound or peroxide, is incorporated in a suitable amount, generally 0.1.to 10% by weight based on the amount of the monomer charged.

The polymerization temperature and time may be those which are known in the art. Generally, it is sufficient to perform the polymerization at a temperature of 40° to 100° C. for 1 to 50 hours. The stirring of the reaction system may be carried out under mild condition so that a homogeneous reaction proceeds as a whole. To prevent inhibition of polymerization by oxygen, the polymerization may be carried out in the reaction system purged with an inert gas such as nitrogen.

Polymerization product

In the present invention, the polymer obtained by the polymerization reaction is measured in terms of molecular weight by a gel permeation chromatography (GPC). The preferred weight average molecular weight ($\overline{M}w$) is 3,000 to 200,000; and the ratio ($\overline{M}w/\overline{M}n$) of the weight average molecular weight ($\overline{M}w$) to the number average molecular weight ($\overline{M}n$) is preferably within a range of from 5 to 50. To obtain a polymerization product having the above-mentioned molecular properties, for example, two or more polymers are separately produced by the polymerization reaction under various conditions so as to have different molecular weights, whereupon these polymers are mixed out in the state of solution to form a single polymerization product. The heat-melting characteristic of the polymerization product is preferably such that the flow starting temperature (Ti) and the melting point (Tm) are respectively within a range of from 90° to 140° C. and within a range of from 110° to 160° C., as measured by a flow tester.

Generally, a flow tester is popular as an effective instrument for examining heat-melting characteristics, such as melt viscosity and fluidability, of a synthetic resin or the like. In the present invention, using the CFT-500 flow tester (manufactured by Shimazu Seisakusho Co., Ltd), measurement of the flow starting temperature (Ti) and the ½ stroke temperature (corresponding to Tm) was made under the following condition:

Increasing rate of
isokinetic temperature: 6° C. per minute
Load pressure: 20 kg/cm$^2$
Bore diameter of a nozzle: 1.0 mm
Bore length of the nozzle: 1.0 mm
Diameter of a plunger: 1 cm
Amount of a sample: 1.5 g.

Preparation of toner

The polymerization product obtained by the polymerization reaction has a good heat-melting characteristic as additives such as a colorant are dispersed in a uniform fashion. After being cooled, this polymerization product is pulverized by a known grinding machine, and then the resulting particles are sized to obtain particles having a particle size of 5 to 20 μm. Alternatively, the same polymerization product may be dissolved in a suitable solution and granulated by spraying and drying to form particles having the above-mentioned particle size. Thus a toner composed of required particles has been produced.

The toner obtained by the present invention may be used with known exterior additive particles admixed, according to need. Such additives may be talc, kaolin, barium sulfate or the like, but preferably aluminum silicate, surface-treated aluminum silicate, titanium dioxide, calcium carbonate, antimony trioxide, barium titanate, calcium titanate, strontium titanate, magnesium oxide, calcium silicate, zinc oxide or the like, especially colloidal silica and surface-treated hydrophobicsilica. By adding hydrophobic silica as an abrasive material, it is possible to improve the flowability of the toner and developer. The preferred average particle diameter of the abrasive material is 1 to 100 μm, especially 10 to 30 μm. The amount of the abrasive material to be added is preferably 0.01 to 1 part by weight per 100 parts by weight of the toner. If the amount of the abrasive material added is less than 0.0part by weight, flowability of the toner would be deteriorated. If it exceeds 1 part by weight, the photosensitive drum surface tends to receive scratches.

To control the electric resistance of the toner the toner may be covered with carbon black, aluminum oxide, etc. The amount of this electric-resistance controlling agent to be added is desirably 0.0 to 1 part by weight per 100 parts by weight of the toner.

Examples of the present invention and Comparative Examples will now be described in detail.

Synthesis of grafted carbon black 50 parts by weight of styrene, 5 parts by weight of carbon black (MA-100 supplied by Mitsubishi Kasei Co., Ltd.), and 0.5 part by weight of AIBN were reacted in the atmosphere of nitrogen at a temperature of 70°C. for 2 hours. The rate of graft (the amount of styrene graft-bonded per unit amount of carbon black) of the resultant carbon black was about 130%.

Fine grinding of charge controlling dye.

1 part by weight of Bontron S-40 (supplied by Orient Chemical Co., Ltd.) was ground for 6 hours in a ball mill by rotation with 3/32-inch stainless steel balls. 10 parts by weight of styrene were added to the resulting dye particles, and the mixture was ground for 6 hours to obtain finer particles.

EXAMPLE 1

| | |
|---|---|
| Styrene | 30 parts by weight |
| Methyl methacrylate | 10 parts by weight |
| Divinylbenzene | 0.5 parts by weight |
| Grafted carbon black (obtained by the above synthesis) | 55 parts by weight |
| Dye (obtained by the above grinding) | 11 parts by weight |
| Toluene | 300 parts by weight |
| AIBN | 1 part by weight |
| LPO | 1 part by weight |

The above ingredients were reacted in the atmosphere of nitrogen at a temperature of 75° C. for 8 hours and further reacted at an increased temperature of 90° C. for 1 hour to complete the polymerization. After being dried under reduced pressure, this polymerization composition was pulverized and sized by a jet mill. As a result, a toner having an average particle diameter of 10 μm was obtained.

The molecular weight of this toner was 10,000; therefore $\overline{M}w/\overline{M}n=9.5$. The flow starting temperature (Ti) and the melting point (Tm) were 121° C. and 140°C., respectively, as measured by a flow tester.

Using this toner, image forming was carried out both at ordinary temperature and humidity (20° C., 60%) and at high temperature and humidity (35° C., 80%) on an electrophotographic copying machine now put on the market under the trade name DC-111 from Mita Industrial Co., Ltd. The results of this image forming are shown in Table 3.

EXAMPLE 2

| | |
|---|---|
| Styrene | 10 parts by weight |
| Butyl acrylate | 10 parts by weight |

-continued

| | |
|---|---|
| Toluene | 300 parts by weight |
| Polymerization initiator (2,2'-azobis(2-4 dimethyl)valeronitrile) | 2 parts by weight |
| Octyl thioglycolate (chain transfer agent) | 0.5 part by weight |

A mixture of the above ingredients was subjected to polymerization in the atmosphere of nitrogen at a temperature of 70° C. for 3 hours to obtain a reactive composition.

Then, the following composition was added to this reactive composition, and the resulting mixture was reacted for 8 hours to complete the polymerization.

Grafted carbon black 55 parts by weight (obtained by the above synthesis)

Charge controlling dye 11 parts by weight (same as that in Example 1) Polypropylene wax 1.8 parts by weight AIBN 1.5 parts by weight The resultant polymerization product was diluted by toluene until such solution includes 10% of solid, and the diluted product was granulated and classified by spraying and drying. As a result, a toner having an average particle diameter of 9.1 μm was obtained.

The molecular weight (Mw) of this toner was 84,000; therefore Mw/Mn=26. The flow starting temperature (Ti) and the melting point (Tm) were 110° C. and 145° C. respectively, as measured by a flow tester.

Using this toner, the same image forming as in Example 1 was carried out. The results of this image forming are shown in Table 3.

EXAMPLE 3

| | |
|---|---|
| Styrene | 9 parts by weight |
| Sodium styrene sulfonate | 1 part by weight |
| Methanol | 8 parts by weight |
| Water | 2 parts by weight |
| AIBN | 0.5 part by weight |

A mixture of the above ingredients was polymerized, and then the resulting composition was dried to form a copolymer composed of styrene and sodium styrene sulfonate.

Then the following composition was reacted in the atmosphere of nitrogen at a temperature of 70° C. for 5 hours and was further reacted at an increased temperature of 90° C. for 2 hours to complete polymerization.

| | |
|---|---|
| Copolymer obtained above | 10 parts by weight |
| Styrene | 20 parts by weight |
| Ethylhexyl acrylate | 20 parts by weight |
| Divinylbenzene | 2.5 parts by weight |
| Grafted carbon black (same as that in Example 1) | 55 parts by weight |
| Toluene | 300 parts by weight |
| AIBN | 2 parts by weight |

After being cooled, this resultant polymerization composition was pulverized and classified to form a toner having an average particle diameter of 10 μm. The molecular weight (Mw) of this toner was 138,000; therefore, Mw/Mn=18. The flow starting temperature (Ti) and the melting point (Tm) were 120° C. and 153° C. respectively, as measured by a flow tester.

Using this toner, the same image forming as in Example 1 was carried out. The results of this image forming are shown in Table 3.

Comparative Example 1

| | |
|---|---|
| Styrene | 90 parts by weight |
| Butyl methacrylate | 10 parts by weight |
| Toluene | 300 parts by weight |
| AIBN | 2 parts by weight |

A mixture of the above ingredients was subjected to polymerization in the atmosphere of nitrogen at a temperature of 75° C. Upon completion of this polymerization, the polymerization product was dried under reduced pressure to form a fixer resin.

Then, the following ingredients were melt-kneaded by a double-axle extrusion kneading machine and were pulverized and classified.. As a result, a toner having an average particle diameter of 10 μm was obtained.

The molecular weight ($\overline{M}w$) of this toner was 95,000; therefore $\overline{M}w/\overline{M}n=4$. The flow starting temperature (Ti) and the melting point (Tm) were 113° C. and 132° C. respectively, as measured by a flow tester.

Using this toner, the same image forming as in Example 1 was carried out. The results of this image forming are shown in Table 3.

Comparative Example 2

| | |
|---|---|
| Styrene | 90 parts by weight |
| Butyl methacrylate | 10 parts by weight |
| Divinylbenzene | 1 part by weight |
| Charge controlling agent (Bontron 9-40, supplied from Orient Chemical Co, Ltd.) | 1 part by weight |
| Carbon black (MA-100, supplied from Mitsubishi Kasei Co., Ltd.) | 5 parts by weight |
| Polypropylene wax (Viscol 550P, supplied from Sanyo Kasei Co., Ltd.) | 1.8 parts by weight |

A polymeric composition composed of the above ingredients was loaded in an aqueous solution of a 2.75% PVA concentration, and the mixture was stirred by a mixer driven at a speed of 6,000 rpm to suspend and disperse the above ingredients, thus forming oil-drop particles. Then, the resulting product was ordinarily stirred in the atmosphere of nitrogen and was subjected to polymerization at a temperature of 80° C. for 5 hours.

The resultant polymerization product was filtered and washed repeatedly and was dried to obtain a toner having an average particle diameter of 10 μm. The molecular weight ($\overline{M}w$) of this toner was 100,000; therefore $\overline{M}w/\overline{M}n=10$. The flow starting temperature (Ti) and the melting point (Tm) were 110° C. and 135° C. respectively, as measured by a flow tester.

Using this toner, the same image forming as in Example 1 was carried out. The results of this image forming are shown in Table 3.

TABLE 3

| | Ordinary temperature · humidity (20° C., 60%) | | | | High temperature · humidity (35° C., 85%) | | | |
|---|---|---|---|---|---|---|---|---|
| | Density of planar image region | Fog density | Resolution (line/mm) | Offset phenomenon | Density of planar image region | Fog density | Resolution (line/mm) | Offset phenomenon |
| Example No. | | | | | | | | |
| 1 | 1.38 | 0.001 | 6.3 | no | 1.36 | 0.002 | 6.0 | no |
| 2 | 1.44 | 0.002 | 6.3 | no | 1.41 | 0.002 | 6.0 | no |
| 3 | 1.32 | 0.001 | 7.0 | no | 1.31 | 0.001 | 6.3 | no |
| Comparative Example | | | | | | | | |
| 1 | 1.33 | 0.004 | 4.0 | yes | 1.32 | 0.005 | 3.7 | yes |
| 2 | 1.40 | 0.002 | 6.3 | yes | 1.21 | 0.006 | 5.0 | yes |

As is apparent from the above Examples and Comparative Examples, according to the process of the present invention, it is possible to produce a toner in which additive components such as a colorant are dispersed minutely and uniformly throughout a fixer resin so that various characteristics and properties, such as melting characteristics, of the fixer resin act effectively. This toner gives a high-resolution and hence sharp image that is free from any offset phenomenon and fogging. Also the toner is superior proof against moisture.

further, with this process, it is possible to produce the above-mentioned toner on a simple apparatus or equipment with a reduced amount of energy, which is very cost-saving. Accordingly this process is particularly suitable for the production of many kinds of toners each in a small quantity.

What is claimed is:

1. A process for producing a toner, for use in developing an electrostatic image, comprising the steps of:

(a) providing a grafted carbon black, said grafted carbon black comprising a carbon black graft polymerized with a fixer resin-forming vinyl monomer, said grafted carbon black having a graft ratio of fixer resin-forming vinyl monomer to carbon black of 20 to 200% by weight;

(b) dispersing said grafted carbon black into at least one fixer resin-forming vinyl monomer or a solution of at least one fixer resin-forming monomer in an organic solvent to produce a predetermined state of dispersion of said grafted carbon black in said at least one fixer resin-forming vinyl monomer;

(c) carrying out bulk polymerization or solution polymerization of said at least one fixer resin-forming vinyl monomer in the presence of a polymerization initiator while maintaining said state of dispersion of said grafted carbon black in said at least one fixer resin forming vinyl monomer;

(d) recovering a polymerized composition comprising a fixer resin and said grafted carbon black dispersed therein;

(e) pulverizing said polymerized composition; and (f) sizing said pulverized composition to obtain said toner.

2. The process according to claim 1, wherein said at least on fixer-resin forming monomer is selected from the group consisting of vinyl aromatic monomers, acrylic monomers, vinyl ester monomers, vinyl ether monomers, diolefin monomers and monoolefin monomers.

3. The process according to claim 2, wherein said vinyl aromatic monomers are of the formula

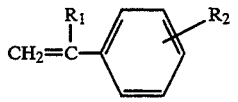

wherein $R_1$ represents a hydrogen atom, a lower alkyl group or a halogen atom, and $R_2$ represents a hydrogen atom, a lower alkyl group, a halogen atom, an alkoxy group, a nitro group or a vinyl group.

4. The process according to claim 2, wherein said acrylic monomers are of the formula $$CH_2{=}\overset{\overset{R_3}{|}}{C}{-}CO{-}O{-}R_4$$

wherein $R_3$ represents a hydrogen atom or a lower alkyl group, and $R_4$ represents a hydrogen atom, a hydrocarbon group having up to 12 carbon atoms, a hydroxyalkyl group or a vinyl ester group.

5. The process according to claim 2, wherein said vinyl ester monomers are of the formula $$CH_2{=}\underset{\underset{O}{\|}}{\overset{\overset{|}{O}}{C}}{-}R_5$$

wherein $R_5$ represents a hydrogen atom or a lower alkyl group.

6. The process according to claim 2, wherein said vinyl ether monomers are of the formula $$CH_2{=}\overset{\overset{|}{O}}{C}H{-}R_6$$

wherein $R_6$ represents a monovalent hydrocarbon group having up to 12 carbon atoms.

7. The process according to claim 2, wherein said diolefin monomers are of the formula $$CH_2{=}\overset{\overset{R_7}{|}}{C}{-}\overset{\overset{R_8}{|}}{C}{=}CH{-}R_9$$

wherein each of $R_7$, $R_8$ and $R_9$ may represent a hydrogen atom, a lower alkyl group or a halogen atom.

8. The process according to claim 2, wherein said monoolefin monomers are of the formula

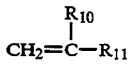

wherein each of $R_{10}$ and $R_{11}$ represents a hydrogen atom or a lower alkyl group.

9. The process according to claim 1, wherein the weight ratio of said grafted carbon black to said at least one fixer resin-forming vinyl monomer is from 1:100 to 20:100.

10. The process according to claim 1, wherein said at least one fixer resin-forming vinyl monomer, in step (b), contains a charge controlling agent in an amount of 0.01 to 10 parts by weight per 100 parts by weight of said at least one fixer resin-forming vinyl monomer.

11. The process according to claim 10, wherein said charge controlling agent is selected from the group consisting of nigrosine, monoazo dye, zinc hexadecylsuccinate, alkylester or alkylamide of naphthoic acid, nitrohumic acid, N,N'-tetramethyldiaminbenzophenone, N,N'-tetramethylbenzidine, triazine and metal-salicylate complex.

12. The process according to claim 1, wherein said at least one fixer resin-forming vinyl monomer, in step (b), contains a wax, having an average molecular weight of from 2,000 to 15,000, in an amount of 1 to 5 parts by weight per 100 parts by weight of said at least one fixer resin-forming vinyl monomer.

13. The process according to claim 12, wherein said wax is selected from the group consisting of low-molecular-weight polypropylene, low-molecular-weight polyethylene and paraffin wax.

14. The process according to claim 1, wherein said at least one fixer resin-forming vinyl monomer, in step (b), contains a polymer having a polar group in an amount of 0.1 to 10 parts by weight per 100 parts by weight of said at least one fixer resin-forming vinyl monomer.

15. The process according to claim 14, wherein said polymer having a polar group is selected from the group consisting of homopolymer of an anionic monomer, homopolymer of a cationic monomer, copolymer of said at least one fixer resin-forming vinyl monomer and an anionic monomer and copolymer of said at least one fixer resin-forming vinyl monomer and a cationic monomer.

16. The process according to claim 15, wherein said anionic monomer is selected from the group consisting of unsaturated carboxylic acids, anhydrides of unsaturated dibasic carboxylic acids, styrene sulfonic acid, 2-acrylamid-2-2-methylpropanesulfonic acid, mono-(2-methacryloyloxyethyl) acid phosphate and 2-methacryloyloxyethylsuccinic acid.

17. The process according to claim 15, wherein said cationic monomer is selected from the group consisting of dimethylamino(meth)acrylate, diethylamino-ethyl(-meth)acrylate, diethylaminopropyl(meth)acrylate, N-amino propyl(meth)acrylate, vinyl pyridine, 2-vinyl imidazole and 2-hydroxy-3-acryloxypropylethyl ammonium chloride.

* * * * *